US010930995B2

(12) United States Patent
Yoshioka et al.

(10) Patent No.: US 10,930,995 B2
(45) Date of Patent: Feb. 23, 2021

(54) POWER DIVIDER/COMBINER

(71) Applicant: MITSUBISHI ELECTRIC CORPORATION, Tokyo (JP)

(72) Inventors: Hideharu Yoshioka, Tokyo (JP); Akimichi Hirota, Tokyo (JP); Naofumi Yoneda, Tokyo (JP); Hidenori Ishibashi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 269 days.

(21) Appl. No.: 16/088,270

(22) PCT Filed: Feb. 2, 2017

(86) PCT No.: PCT/JP2017/003817
§ 371 (c)(1),
(2) Date: Sep. 25, 2018

(87) PCT Pub. No.: WO2017/208499
PCT Pub. Date: Dec. 7, 2017

(65) Prior Publication Data

US 2020/0235456 A1 Jul. 23, 2020

(30) Foreign Application Priority Data

Jun. 3, 2016 (WO) ..... PCT/JP2016/066555

(51) Int. Cl.
*H01P 5/12* (2006.01)
*H01P 5/19* (2006.01)
*H01P 1/32* (2006.01)

(52) U.S. Cl.
CPC . *H01P 5/19* (2013.01); *H01P 1/32* (2013.01)

(58) Field of Classification Search
CPC ..... H01P 5/12; H01P 5/19
(Continued)

(56) References Cited

U.S. PATENT DOCUMENTS 4,875,024 A 10/1989 Roberts
6,411,175 B1 * 6/2002 Sugawara ..... H01P 5/16 333/124

(Continued)

FOREIGN PATENT DOCUMENTS

JP 11-330813 A 11/1999
JP 2000-106501 A 4/2000

OTHER PUBLICATIONS

Extended European Search Report issued in corresponding European Application No. 17806061.2 dated Mar. 21, 2019.

(Continued)

*Primary Examiner* — Dean O Takaoka
(74) *Attorney, Agent, or Firm* — Birch, Stewart, Kolasch & Birch, LLP.

(57) ABSTRACT

Provided is a power divider/combiner capable of improving reflection characteristics and isolation characteristics. The power divider/combiner is formed by a multilayer board, and a strip conductor is arranged in an inner layer of the multilayer board and a chip resistor is arranged on an outer surface of the multilayer board. The power divider/combiner includes vias, which connect the strip conductor and the chip resistor, and includes stubs mounted between input/output terminals and the vias. With this configuration, it is possible to adjust induction mainly during an odd mode of an even/odd mode operation and to consequently improve reflection characteristics of the input/output terminals and isolation characteristics between the input/output terminals.

18 Claims, 8 Drawing Sheets

(58) Field of Classification Search
USPC ..... 333/124–128, 132–136
See application file for complete search history.

(56) References Cited

U.S. PATENT DOCUMENTS

| | | | | |
|---|---|---|---|---|
| 6,437,806 | B1 | 8/2002 | Iwasa | |
| 6,489,859 | B1 * | 12/2002 | Tahara | H01P 5/16 333/120 |
| 8,471,647 | B2 * | 6/2013 | Tahara | H01P 5/16 333/128 |
| 2016/0064791 | A1 | 3/2016 | Ono et al. | |

OTHER PUBLICATIONS

Chinese Office Action and Search Report for Chinese Application No. 201780032824.9, dated Jul. 23, 2020, with an English translation.

* cited by examiner

POWER DIVIDER/COMBINER

TECHNICAL FIELD

The present invention relates to a power divider/combiner configured to divide or combine mainly high frequency signals of a microwave band and a millimeter wave band.

BACKGROUND ART

Generally, power dividers/combiners are widely used to divide or combine high frequency signals. A Wilkinson power divider/combiner among those power dividers/combiners is used in a case where an isolation is required to be secured between output terminals when the Wilkinson power divider/combiner functions as a divider, or an isolation is required to be secured between input terminals when the Wilkinson power divider/combiner functions as the combiner.

The related-art Wilkinson power divider/combiner includes one common terminal and two input/output terminals. The common terminal becomes an input terminal during signal division, and becomes an output terminal during signal combining. The two input/output terminals become output terminals during signal division, and become input terminals during signal combining. The common terminal and each input/output terminal are connected to each other by a quarter-wave ($\lambda/4$) impedance transformer. Further, the input/output terminals are connected to each other via one isolation resistor called an absorption resistor.

For example, in Patent Literature 1, there is disclosed a configuration of such a Wilkinson power divider/combiner, in which a transmission line whose electrical length is half a wavelength ($\lambda/2$) of an operating frequency or an integer multiple of half the wavelength is provided between each input/output terminal and an isolation resistor. The power divider/combiner described in Patent Literature 1 employs such a configuration of a transmission line that a phase difference between a route that connects two input/output terminals via two quarter-wave impedance transformers and a route that connects two input/output terminals via an isolation resistor (absorption resistor) is an odd multiple of 180 degrees on a power propagation route that connects the input/output terminals, to thereby achieve improvement of a degree of design freedom.

The integer multiple of half the wavelength relates to a frequency, and is therefore a multiple of a natural number (1, 2, 3 . . . ) except 0 and negative numbers, strictly speaking (the same applies below).

Further, for example, in Patent Literature 2, there is disclosed a Wilkinson power divider/combiner employing a configuration in which a transmission line and a stub are provided between each input/output terminal and an isolation resistor. The power divider/combiner described in Patent Literature 2 includes a distributed constant line as a transmission line between each input/output terminal and the isolation resistor. Thus, it is possible to provide the power divider/combiner enabling improvement of reflection characteristics of each input/output terminal, which have deteriorated due to an influence of a capacitive reactance of the isolation resistor, and an isolation between the input/output terminals. Further, it is possible to provide the power divider/combiner capable of reducing a line length of the distributed constant line by inserting a stub in the transmission line provided between each input/output terminal and the isolation resistor, to thereby miniaturize a circuit.

CITATION LIST

Patent Literature

[PTL 1] US 4875024 B2
[PTL 2] JP 2000-106501 A

SUMMARY OF INVENTION

Technical Problem

Some Wilkinson power dividers/combiners formed by a multilayer board adopt such a structure that a strip conductor pattern, for example, a quarter-wave impedance transformer, is provided in a multilayer board inner layer, a chip resistor is provided as an isolation resistor on an outer surface of the multilayer board, and those strip conductor pattern and chip resistor are connected to each other by an inter-layer connection conductor called a via. In the power divider/combiner adopting such a structure, when a board thickness becomes thicker and a strip conductor pattern is arranged deeper in an inner layer, an influence due to an electrical length of the via and impedance discontinuity caused by a via portion cannot be ignored, and therefore reflection characteristics of a common terminal, reflection characteristics of each input/output terminal, and an isolation between input/output terminals deteriorate.

In the power divider/combiner employing a configuration described in Patent Literature 1, a transmission line whose electrical length is half a wavelength of an operating frequency or an integer multiple of half the wavelength is provided between each input/output terminal and the isolation resistor, and thus it is possible to absorb an influence of the electrical length of the via that connects the isolation chip resistor on the outer surface and the strip conductor pattern in the inner layer. However, there is a problem in that the reflection characteristics of each input/output terminal and the isolation between the input/output terminals deteriorate due to the influence of the impedance discontinuity occurring at the via portion.

Further, in the power divider/combiner employing the configuration described in Patent Literature 2, too, the distributed constant line is provided as a transmission line whose electrical length (approximately 164 deg (physical length: 42.6 mm)) is close to half a wavelength of an operating frequency (2.16 GHz) between each input/output terminal and the isolation resistor, and thus it is possible to absorb an influence of the electrical length of the via that connects the isolation chip resistor on the outer surface and the strip conductor pattern in the inner layer. However, there is a problem in that the reflection characteristics of each input/output terminal and the isolation between the input/output terminals deteriorate due to the influence of the impedance discontinuity occurring at the via portion.

Further, although, through insertion of a stub in a transmission line provided between each input/output terminal and the isolation resistor in the power divider/combiner employing the configuration described in Patent Literature 2, it is possible to reduce a transmission line whose electrical length is close to half the wavelength of the operating frequency, in Patent Literature 2, there is no suggestion or explicit indication of improvement of reflection characteristics of each input/output terminal and the isolation between the input/output terminals that deteriorate due to an influence of impedance discontinuity occurring at a via portion.

The present invention has been made to solve the above-mentioned problems, and an object of the present invention is to provide a power divider/combiner that adopts a structure suitable for a small and stacked structure when the power divider/combiner is formed by using a multilayer board, and has satisfactory reflection characteristics and isolation characteristics of a common terminal and each input/output terminal.

Solution to Problem

According to one embodiment of the present invention, there is provided, for example, a power divider/combiner including: a common terminal configured to receive input of a high frequency signal to be divided, or output a combined high frequency signal; a first input/output terminal and a second input/output terminals, which are configured to output a divided high frequency signal or receive input of a high frequency signal to be combined; a first quarter-wave impedance transformer including one end connected to the common terminal and another end connected to the first input/output terminal; a second quarter-wave impedance transformer including one end connected to the common terminal and another end connected to the second input/output terminal; an isolation resistor configured to prevent an interference between a high frequency signal of the first input/output terminal and a high frequency signal of the second input/output terminal; a first line configured to connect the isolation resistor and the first input/output terminal, and having a length that is an integer multiple of half a wavelength; and a second line configured to connect the isolation resistor and the second input/output terminal, and having a length that is an integer multiple of half a wavelength, wherein at least two or more of line portions of the first line and the second line have different impedances and are connected in cascade, wherein the first line includes a first stub at a line portion located at a center in a longitudinal direction of the first line or on a side closer to the first input/output terminal than the center, and wherein the second line includes a second stub at a line portion located at a center in a longitudinal direction of the second line or on a side closer to the second input/output terminal than the center.

Advantageous Effects of Invention

According to one embodiment of the present invention, it is possible to provide the power divider/combiner that adopts the structure suitable for a small and stacked structure when the power divider/combiner is formed by using a multilayer board, and has satisfactory reflection characteristics and isolation characteristics of the common terminal and each input/output terminal.

DESCRIPTION OF EMBODIMENTS

According to the present invention, a power divider/combiner is configured as a Wilkinson power divider/combiner formed by a multilayer board. In the Wilkinson power divider/combiner, a strip conductor pattern that forms a quarter-wave ($\lambda/4$) impedance transformer is provided in a multilayer board inner layer, and a chip resistor is provided as an isolation resistor on an outer surface of the multilayer board. The strip conductor pattern and the chip resistor are connected to each other by a transmission line that includes a via and a strip conductor, and has a length that is an integer multiple of half a wavelength ($\lambda/2$). Further, in particular, the strip conductor arranged between the via and an input/ output terminal is provided with a stub. According to this configuration, an even/odd mode operation of the power divider/combiner can achieve improvement of reflection characteristics of the input/output terminal mainly during an odd mode operation. Consequently, it is possible to suppress an influence of impedance discontinuity caused by the via, and to keep satisfactory reflection characteristics of the common terminal and each input/output terminal, and a satisfactory isolation between the input/output terminals.

Although, in the above-mentioned example, the strip conductor pattern and the chip resistor are connected to each other by a transmission line that includes the via and the strip conductor and has a length that is an integer multiple of half the wavelength (λ/2) and is an odd multiple of half the wavelength, the strip conductor pattern and the chip resistor are not limited to this pattern. The strip conductor pattern and the chip resistor may be connected to each other by a transmission line that includes the via and the strip conductor and has a length that is the integer multiple of half the wavelength (λ/2) and is an even multiple of half the wavelength. Regarding the transmission line that has a length that is an even multiple of half the wavelength (λ/2), this configuration can achieve improvement of reflection characteristics of the input/output terminals mainly during the even mode operation of the even/odd mode operation of the power combiner/divider. Therefore, it is possible to suppress an influence of the impedance discontinuity caused by the via, and to keep satisfactory reflection characteristics of the common terminal and each input/output terminal, and a satisfactory isolation between the input/output terminals.

Now, a power divider/combiner according to each of embodiments of the present invention is described with reference to the drawings. In each of the embodiments, the same or corresponding portions are denoted by the same reference symbols, and the overlapping description thereof is omitted.

First Embodiment

Figure 1:
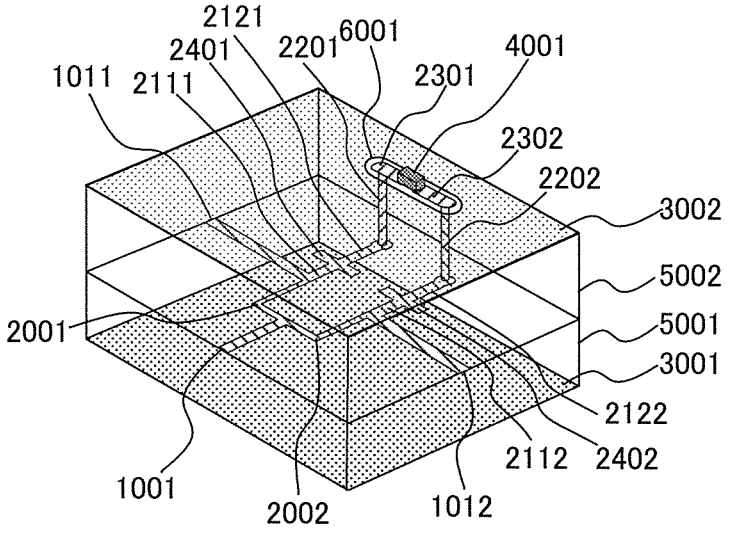
FIG. 1 is a transparent perspective view for illustrating an example of a configuration of a power divider/combiner according to a first embodiment of the present invention.

FIG. 1 is a configuration diagram for illustrating an example of a power divider/combiner according to the first embodiment of the present invention, and is a transparent perspective view thereof. In the first embodiment, a description is given of a Wilkinson power divider/combiner that is formed mainly by a multilayer board, and adopts a structure in which a strip conductor pattern of a quarter-wave (λ/4) impedance transformer is provided in a multilayer board inner layer, a chip resistor is provided as an isolation resistor on an outer surface of the multilayer board, and the strip conductor pattern and the chip resistor are connected to each other by a transmission line that includes a via and a strip conductor and has a length that is an integer multiple of half a wavelength (λ/2).

In FIG. 1, a common terminal 1001, an input/output terminal 1011, an input/output terminal 1012, a quarter-wave impedance transformer strip conductor 2001, a quarter-wave impedance transformer strip conductor 2002, a transmission line strip conductor 2111, a transmission line strip conductor 2112, a transmission line strip conductor 2121, a transmission line strip conductor 2122, a stub 2401, and a stub 2402 are arranged between a dielectric layer 5001 and a dielectric layer 5002.

A ground conductor 3002, a chip resistor mounting conductor pattern 2301, a chip resistor mounting conductor pattern 2302, and a chip resistor 4001, which are indicated by the dot hatching, are arranged on a surface of the dielectric layer 5002 opposite to a surface on which the dielectric layer 5001 is arranged.

The ground conductor 3001 is arranged on a surface of the dielectric layer 5001 opposite to a surface on which the dielectric layer 5002 is arranged.

A via 2201 and a via 2202 are arranged so as to penetrate the dielectric layer 5002.

The λ/4 impedance transformer strip conductor 2001 connects the common terminal 1001 and the input/output terminal 1011.

The λ/4 impedance transformer strip conductor 2002 connects the common terminal 1001 and the input/output terminal 1012.

The transmission line strip conductor 2111, the stub 2401, the transmission line strip conductor 2121, the via 2201, and the chip resistor mounting conductor pattern 2301 connect the input/output terminal 1011 and the chip resistor 4001.

The transmission line strip conductor 2112, the stub 2402, the transmission line strip conductor 2122, the via 2202, and the chip resistor mounting conductor pattern 2302 connect the input/output terminal 1012 and the chip resistor 4001.

The chip resistor mounting conductor 2301 and the chip resistor mounting conductor 2302 are arranged in a cutout 6001 formed in the ground conductor 3002.

The chip resistor 4001, which serves as an isolation resistor, connects the chip resistor mounting conductor pattern 2301 and the chip resistor mounting conductor pattern 2302. One end of the chip resistor 4001 is mounted to be located above the chip resistor mounting conductor pattern 2301, and the other end of the chip resistor 4001 is mounted to be located above the chip resistor mounting conductor pattern 2302.

The stub 2401 is provided between the transmission line strip conductor 2111 and the transmission line strip conductor 2121. The stub 2402 is provided between the transmission line strip conductor 2112 and the transmission line strip conductor 2122.

Figure 3:
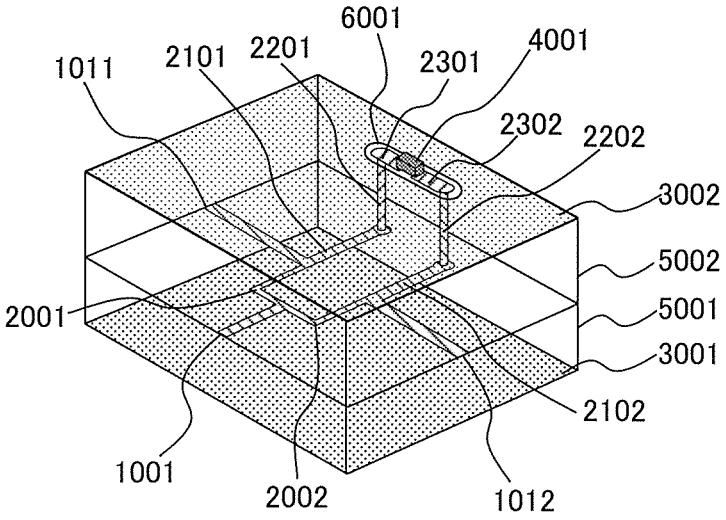
FIG. 3 is a transparent perspective view for illustrating an example of a configuration of the power divider/combiner of the related-art structure formed by the multilayer board.
Figure 2A:
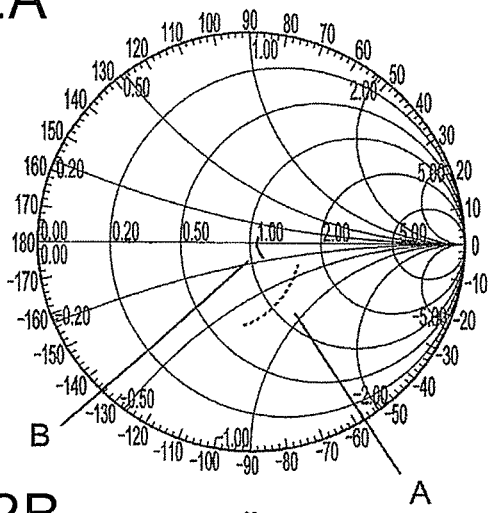
FIG. 2A to FIG. 2C are explanatory charts for showing a result of simulation during an even/odd mode operation related to a power divider/combiner of a related-art structure formed by a multilayer board, which is illustrated in FIG. 3, and a power divider/combiner of a structure in the present invention, which is illustrated in FIG. 1.
Figure 2B:
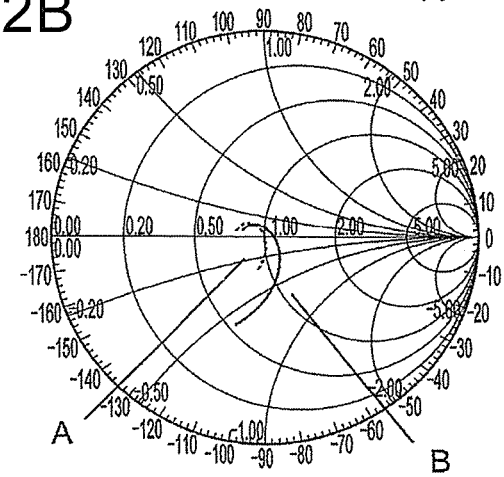
Figure 2C:
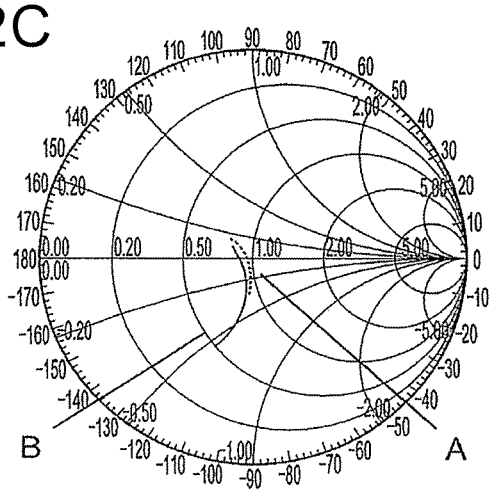

FIG. 2A to FIG. 2C are views for illustrating a result of simulation indicated by a Smith chart related to an even/odd mode operation of a power divider/combiner illustrated in a transparent perspective view of FIG. 3, which is obtained by forming a power divider/combiner of a related-art structure disclosed in Patent Literature 1 by a multilayer board, and the power divider/combiner according to the first embodiment of the present invention illustrated in FIG. 1. A case of Patent Literature 1 is indicated by A, and a case of the first embodiment of the present invention is indicated by B.

Further, in the power divider/combiner according to the first embodiment related to this simulation, a total length of the transmission line strip conductor 2111, the transmission line strip conductor 2121, the chip resistor mounting conductor pattern 2301, and the via 2201, and a total length of the transmission line strip conductor 2112, the transmission line strip conductor 2122, the chip resistor mounting conductor pattern 2302, and the via 2202 are odd multiples of half the wavelength (λ/2).

In addition, this simulation equally divides a plane of symmetry of an example of the related-art power divider/combiner illustrated in FIG. 3 and the power divider/combiner according to the present invention illustrated in FIG. 1, and calculates divided planes as electric walls (during an odd mode operation) or magnetic walls (during an even mode operation). FIG. 2A is an illustration of reflection characteristics of the input/output terminal 1011 or the input/output terminal 1012 during the odd mode operation, FIG. 2B is an illustration of reflection characteristics of the input/output terminal 1011 or the input/output terminal 1012 during the even mode operation, and FIG. 2C is an illustration of a range of 20% in fractional band of the reflection characteristics of the common terminal 1001 during the even mode operation.

In FIG. 2A, focusing on the reflection characteristics of the input/output terminal 1011 or the input/output terminal 1012 during the odd mode operation, it is found that the power divider/combiner according to the present invention illustrated in FIG. 1 can obtain characteristics close to a center (reflection zero point) of the Smith chart compared to the related-art power divider/combiner illustrated in FIG. 3.

Further, it is found that the reflection characteristics of the input/output terminal 1011 or the input/output terminal 1012 during the even mode operation of FIG. 2B and reflection characteristics of the common terminal 1001 during the even mode operation of FIG. 2C do not substantially change between the related-art power divider/combiner illustrated in FIG. 3 and the power divider/combiner according to the present invention illustrated in FIG. 1.

Figure 4A:
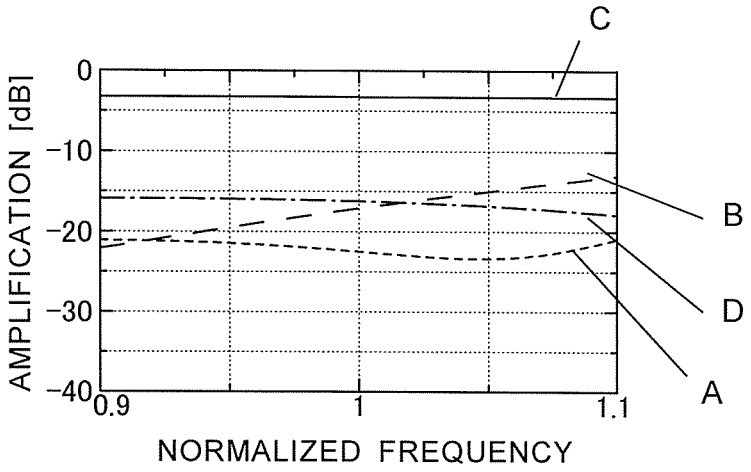
FIG. 4A and FIG. 4B are graphs for showing a result of simulation during power division related to reflection characteristics and isolation characteristics of the power divider/combiner of the related-art structure formed by the multilayer board, which is illustrated in FIG. 3, and the power divider/combiner of the structure in the present invention, which is illustrated in FIG. 1.
Figure 4B:
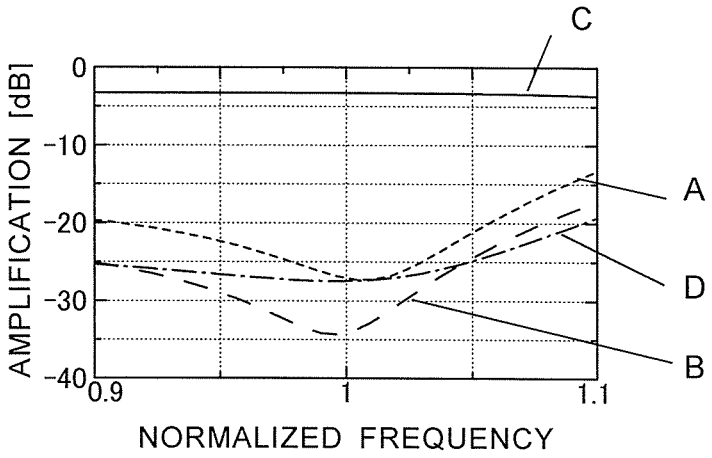

FIG. 4A and FIG. 4B are views for illustrating a result of simulation during power distribution related to reflection characteristics and isolation characteristics of the related-art power divider/combiner formed by the multilayer board illustrated in FIG. 3 and the power divider/combiner adopting the structure according to the present invention illustrated in FIG. 1. FIG. 4A is an illustration of a result of the related-art power divider/combiner illustrated in FIG. 3. FIG. 4B is an illustration of a result of the power divider/combiner according to the present invention illustrated in FIG. 1.

In FIG. 4A and FIG. 4B, dotted lines A indicate reflection characteristics of the common terminal 1001, long broken lines B indicate reflection characteristics of the input/output terminal 1011 or the input/output terminal 1012, solid lines C indicate pass characteristics (division characteristics) from the common terminal 1001 to the input/output terminal 1011 or the input/output terminal 1012, and dashed-dotted lines D indicate isolation characteristics between the input/output terminal 1011 and the input/output terminal 1012.

In FIG. 4A, focusing on the reflection characteristics of the input/output terminal 1011 or the input/output terminal 1012 indicated by the long broken line B and the isolation characteristics between the input/output terminal 1011 and the input/output terminal 1012 indicated by the dashed-dotted line D while, for example, a normalized frequency is 1, it is found that the simulation result related to the related-art power divider/combiner exhibits degraded values of −17 dB in reflection amount and −16 dB in isolation amount.

In FIG. 4B, focusing on the reflection characteristics of the input/output terminal 1011 or the input/output terminal 1012 indicated by the long broken line B and the isolation characteristics between the input/output terminal 1011 and the input/output terminal 1012 indicated by the dashed-dotted line D while, for example, the normalized frequency is 1, it is found that the simulation result related to the power divider/combiner according to the present invention exhibits satisfactory values of −34 dB in reflection amount and −27 dB in isolation amount.

As apparent from the above, the power divider/combiner according to the first embodiment includes the stub 2401 and the stub 2402, and thus it is possible to obtain an effect of providing the power divider/combiner that can improve the reflection characteristics of the input/output terminal during the odd mode operation, which have deteriorated due to an influence of impedance discontinuity caused by the transmission line strip conductor 2121, the via 2201, and the chip resistor mounting conductor pattern 2301, and impedance discontinuity caused by the transmission line strip conductor 2122, the via 2202, and the chip resistor mounting conductor pattern 2302, and has satisfactory various reflection characteristics and isolation characteristics during a power dividing operation and a power combining operation.

Figure 5:
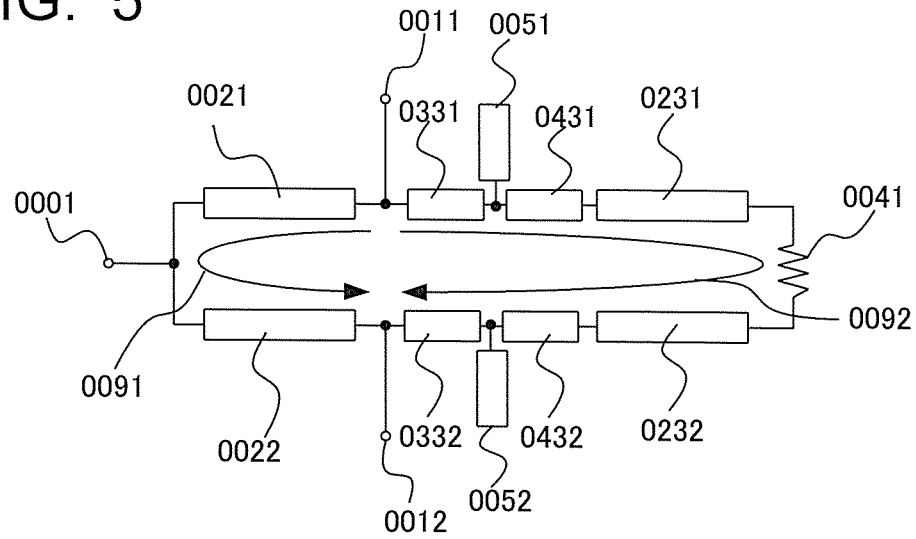
FIG. 5 is an equivalent circuit diagram of the power divider/combiner according to the first embodiment of the present invention.

FIG. 5 is an equivalent circuit diagram of the power divider/combiner according to the first embodiment of the present invention in FIG. 1.

Figure 6:
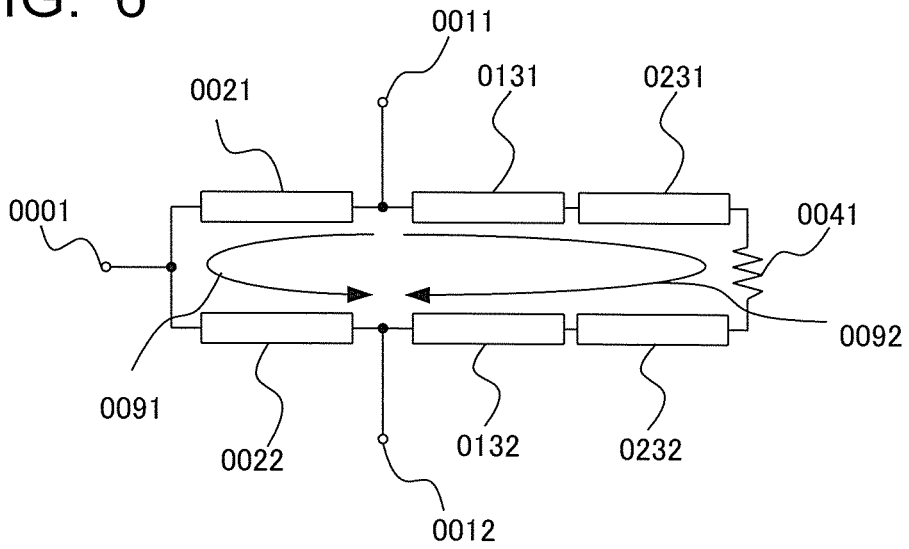
FIG. 6 is an equivalent circuit diagram of the power divider/combiner of the related-art structure formed by the multilayer board.

FIG. 6 is an equivalent circuit diagram of the power divider/combiner of the related-art structure formed by the multilayer board illustrated in FIG. 3.

When the equivalent circuit diagrams of FIG. 5 and FIG. 6 are compared with each other, a transmission line 0131 and a transmission line 0132, which are transmission lines on a side of input/output terminals 0011 and 0012 in FIG. 6, are replaced with a transmission line 0331, a transmission line 0431, and a stub 0051, and a transmission line 0332, a transmission line 0432, and a stub 0052 in FIG. 5, respectively.

In FIG. 5, a transmission line 0231 has an impedance different from those of the transmission line 0331 and the transmission line 0431, and a transmission line 0232 has an impedance different from those of the transmission line 0332 and the transmission line 0432, and therefore impedance discontinuity occurs.

In the first embodiment, the power divider/combiner is formed by the multilayer board including two layers of the dielectric layers 5001 and 5002. However, the power divider/combiner is not limited to this, and may be formed by a multilayer board including three or more dielectric layers.

Figure 7:
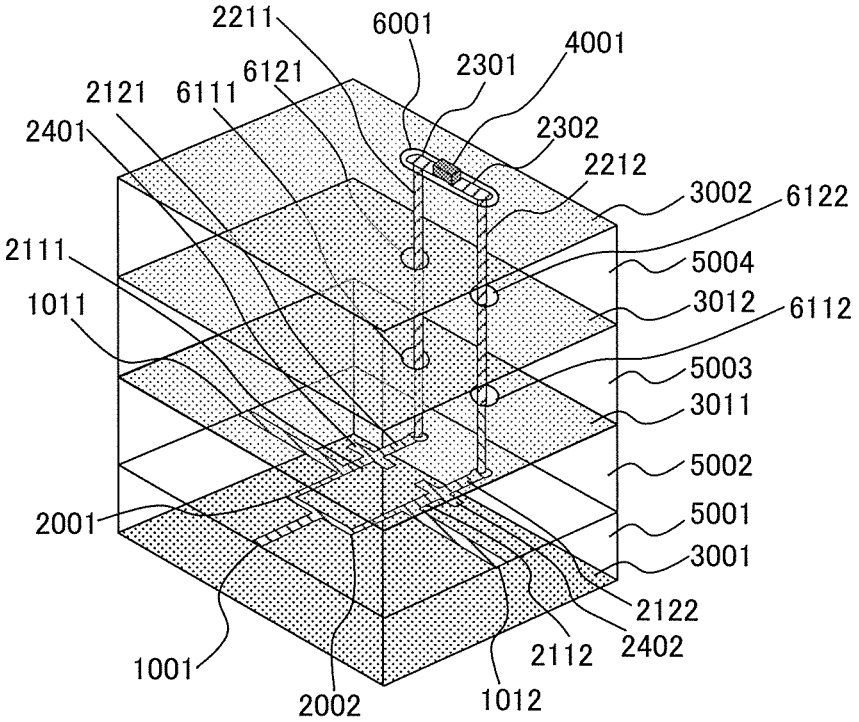
FIG. 7 is a transparent perspective view for illustrating another example of the configuration of the power divider/combiner according to the first embodiment of the present invention.

FIG. 7 is a configuration diagram for illustrating the power divider/combiner according to the first embodiment of the present invention, which is formed by a multilayer board including four dielectric layers, and is a transparent perspective view thereof.

In the example in FIG. 7, a dielectric layer 5003 is arranged on the surface of the dielectric layer 5002 opposite to the surface on which the dielectric layer 5001 is arranged, and a dielectric layer 5004 is arranged on a surface of the dielectric layer 5003 opposite to the surface on which the dielectric layer 5002 is arranged.

Further, a ground conductor 3011 is arranged between the dielectric layer 5002 and the dielectric layer 5003, and a ground conductor 3012 is arranged between the dielectric layer 5003 and the dielectric layer 5004.

The ground conductor 3002, the chip resistor mounting conductor pattern 2301, the chip resistor mounting conductor pattern 2302, and the chip resistor 4001 are arranged on a surface of the dielectric layer 5004 opposite to a surface on which the dielectric layer 5003 is arranged.

The ground conductor 3011 is provided with a cutout 6111 and a cutout 6112, and the ground conductor 3012 is provided with a cutout 6121 and a cutout 6122.

A via 2211 and a via 2212 are arranged so as to penetrate the dielectric layer 5002, the dielectric layer 5003, and the dielectric layer 5004, penetrate the cutout 6111 and the cutout 6112 in the ground conductor 3011, and penetrate the cutout 6121 and the cutout 6122 in the ground conductor 3012.

The transmission line 2111, the stub 2401, the transmission line strip conductor 2121, the via 2211, and the chip resistor mounting conductor pattern 2301 connect the input/output terminal 1011 and the chip resistor 4001.

The transmission line 2112, the stub 2402, the transmission line strip conductor 2122, the via 2212, and the chip resistor mounting conductor pattern 2302 connect the input/output terminal 1012 and the chip resistor 4001.

In the example in FIG. 7, even when a total number of boards and the board thickness of the multilayer board increase and the electrical lengths of the vias exceed half the wavelength of the operating frequency, the same effect as that of the above-mentioned example can be obtained.

Figure 8:
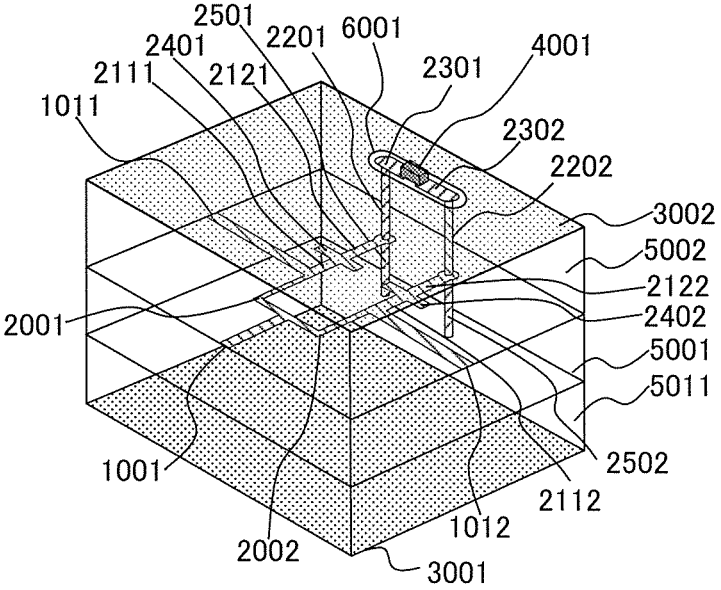
FIG. 8 is a transparent perspective view for illustrating still another example of the configuration of the power divider/combiner according to the first embodiment of the present invention.

Further, although FIG. 1 is an illustration of a configuration example in which the via 2201 and the via 2202 are made so as to penetrate only the dielectric layer 5002, the via 2201 and the via 2202 are not limited to this, and may adopt structures made so as to penetrate the dielectric layer 5001 as illustrated in FIG. 8. Even when the via 2201 includes a stub 2501, the via 2202 includes a stub 2502, and the stub 2501 and the stub 2502 operate as impedance discontinuous portions, the power divider/combiner illustrated in the transparent perspective view of FIG. 8 can obtain the same effect as the above-mentioned example.

A dielectric layer 5011 is arranged on a surface of the dielectric layer 5001 opposite to the surface on which the dielectric layer 5002 is arranged. Further, the ground conductor 3001 is arranged on a surface of the dielectric layer 5011 opposite to the surface on which the dielectric layer 5001 is arranged.

In addition, this configuration can be carried out by the configuration of FIG. 7, the via 2201 may include the stub 2501, the via 2202 may include the stub 2502, and the stub 2501 and the stub 2502 may adopt structures made so as to penetrate the dielectric layer 5001 as illustrated in FIG. 8. Further, as illustrated in FIG. 8, the dielectric layer 5011 is arranged on the surface of the dielectric layer 5001 opposite to the surface on which the dielectric layer 5002 is arranged.

Figure 9A:
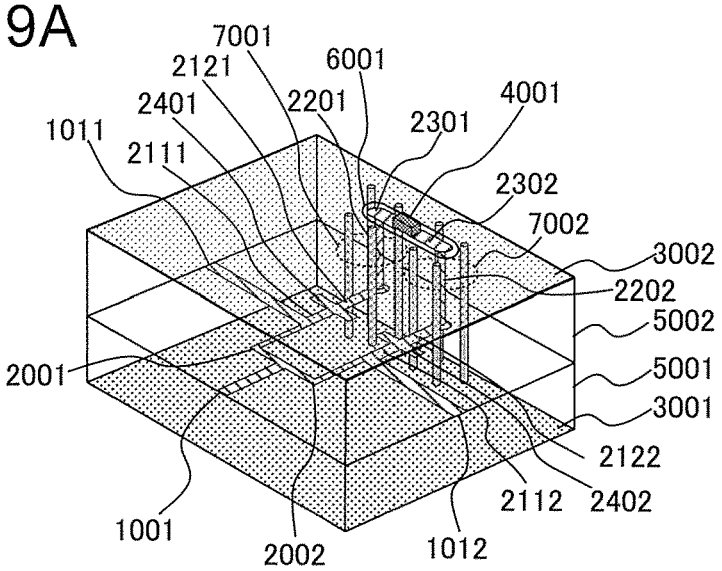
FIG. 9A and FIG. 9B are views for illustrating still another example of the configuration of the power divider/combiner according to the first embodiment of the present invention.
Figure 9B:
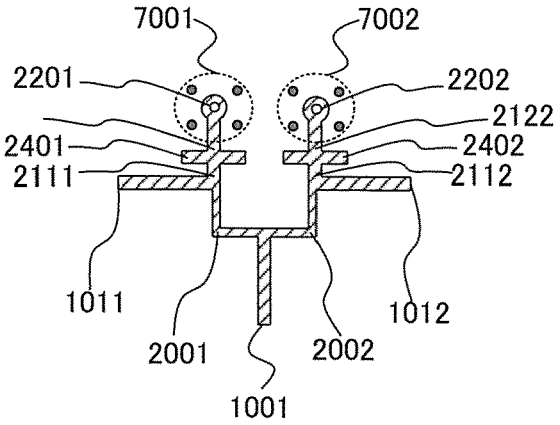

Further, in the above-mentioned example, the power divider/combiner uses vias configured to transmit power and signals. However, the power divider/combiner is not limited to this, and may be a power divider/combiner that also uses vias configured to operate as ground conductors. FIG. 9A and FIG. 9B are configuration diagrams for illustrating the power divider/combiner according to the first embodiment of the present invention that also uses the vias configured to operate as the ground conductors. FIG. 9A is the same transparent perspective view as that of FIG. 1, and FIG. 9B is a top view for illustrating the vias configured to operate as a strip conductor and a ground conductor arranged in the dielectric layer 5001 and the dielectric layer 5002 without the dielectric layer and the ground conductor.

In the example of FIG. 9A and FIG. 9B, ground outer conductor vias 7001 and ground outer conductor vias 7002 penetrate the dielectric layer 5001 and the dielectric layer 5002, and connect the ground conductor 3001 and the ground conductor 3002. Further, the plurality of ground outer conductor vias 7001 are arranged in parallel to the via 2201 surrounding the via 2201 in a plane perpendicular to an axial direction of the via 2201. Similarly, the plurality of ground outer conductor vias 7002 are also arranged in parallel to the via 2202 surrounding the via 2202 in a plane perpendicular to the axial direction of the via 2202.

The power divider/combiner illustrated in FIG. 9A and FIG. 9B includes the vias 7001 and 7002 configured to function as the ground conductors around the vias 2201 and 2202 configured to function as signal conductors. Thus, it is possible to provide the power divider/combiner that can achieve signal transmission in a coaxial mode in an interlayer connection portion, suppress power leakage, and achieve low loss, and to obtain the same effect as the above-mentioned example.

Figure 10:
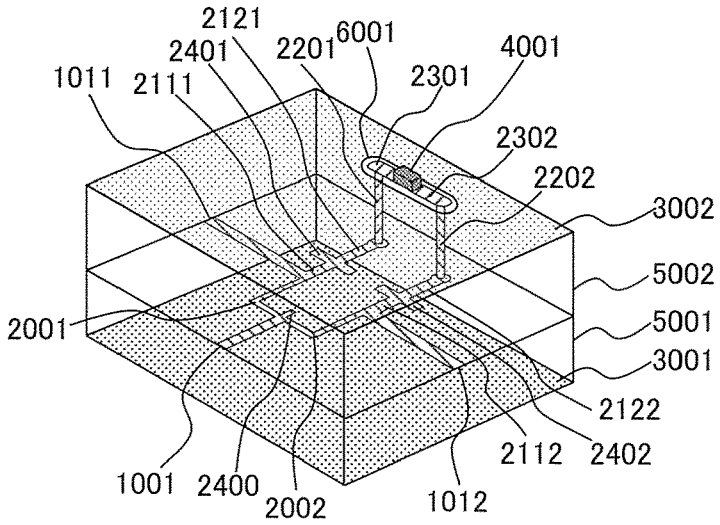
FIG. 10 is a transparent perspective view for illustrating still another example of the configuration of the power divider/combiner according to the first embodiment of the present invention.

Further, in the above-mentioned example, there has been described an example in which stubs that can be adjusted only during the odd mode of the even/odd mode operation are provided. However, the stubs are not limited to this, and stubs that can be adjusted only during the even mode may be provided simultaneously to individually adjust the even/odd mode. FIG. 10 is a configuration diagram for illustrating the power divider/combiner according to the first embodiment of the present invention that includes stubs that can be adjusted only during each mode of the even/odd mode operation, and is a transparent perspective view thereof.

In the example of FIG. 10, a stub 2400 is arranged at a point at which the λ/4 impedance transformer strip conductor 2001 and the λ/4 impedance transformer strip conductor 2002 are connected.

The power divider/combiner illustrated in FIG. 10 includes the stub 2400, the stub 2401, and the stub 2402, and thus it is possible to obtain the power divider/combiner having a high degree of design freedom, and to obtain the same effect as that of the above-mentioned example.

Second Embodiment

In the first embodiment, a description has been given of the power divider/combiner employing a configuration that uses trip lines. However, a power divider/combiner employing a configuration that uses microstrip lines may be used.

Figure 11:
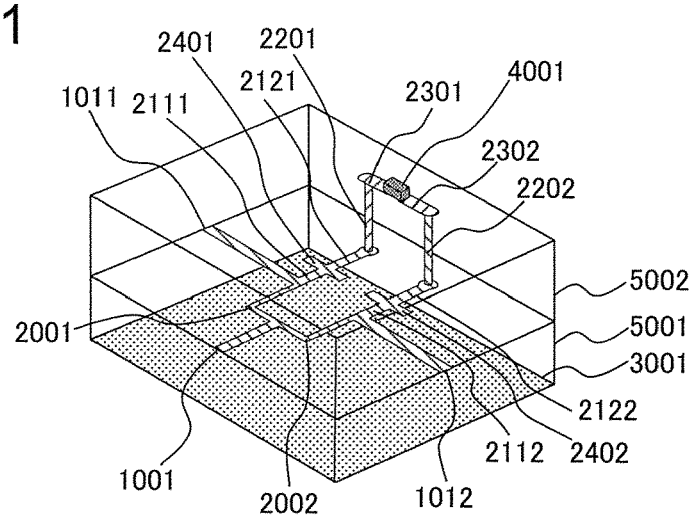
FIG. 11 is a transparent perspective view for illustrating an example of a configuration of a power divider/combiner according to a second embodiment of the present invention.

FIG. 11 is a configuration diagram for illustrating a power divider/combiner that uses microstrip lines according to a second embodiment of the present invention, and is a transparent perspective view thereof. The microstrip line adopts a structure that makes dielectric layers and outer conductors above inner conductors unnecessary in the strip line in each of the above-mentioned examples.

In the power divider/combiner of FIG. 11, inner conductors denoted by reference numerals 1001, 2001, 1011, 2111, 2401, 2121, 2122, 2402, 2112, 1012 and 2002 in each of the above-mentioned examples are formed by the microstrip lines. Accordingly, ground conductors are not arranged on a surface of a dielectric layer 5002 opposite to a surface on which a dielectric layer 5001 is arranged.

According to the second embodiment, it is possible to widen an impedance control range of each transmission line by using the microstrip lines, to thereby improve the degree of design freedom and obtain the same effect as that of the first embodiment.

Third Embodiment

In the first and second embodiments, a description has been given of the power divider/combiner that connects the common terminal 1001 and the input/output terminals 1011 and 1012 by each λ/4 impedance transformer. In the present invention, one end of the λ/4 impedance transformer may be connected to the common terminal 1001, and the other end of the λ/4 impedance transformer and the input/output terminals 1011 and 1012 may be connected to each other by each λ/4 transmission in the power divider/combiner.

Figure 12:
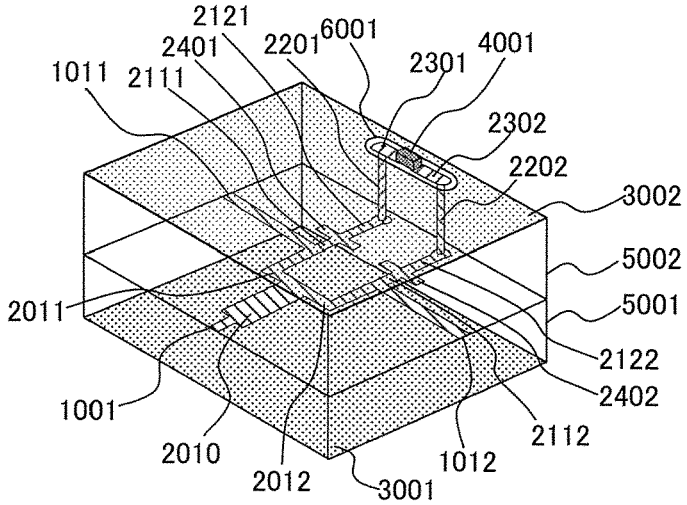
FIG. 12 is a transparent perspective view for illustrating an example of a configuration of a power divider/combiner according to a third embodiment of the present invention.

FIG. 12 is a configuration diagram for illustrating a power divider/combiner according to a third embodiment of the present invention, and is a transparent perspective view thereof.

In the example of FIG. 12 in the third embodiment, a quarter-wave (λ/4) impedance transformer strip conductor 2010 is connected to the common terminal 1001. Further, a terminal opposite to the terminal of the λ/4 impedance transformer strip conductor 2010 connected to the common terminal 1001, and the input/output terminal 1011 are connected to each other by a quarter-wave (λ/4) strip conductor 2011. Further, a terminal opposite to a terminal of the λ/4 impedance transformer strip conductor 2010 connected to the common terminal 1001, and the input/output terminal 1012 are connected to each other by a quarter-wave (λ/4) strip conductor 2012.

According to the third embodiment, the λ/4 impedance transformer strip conductor 2010 can form a low impedance transmission line through provision of the λ/4 impedance transformer strip conductor 2010 between the common terminal 1001, and the λ/4 strip conductor 2011 and the λ/4 strip conductor 2012. Thus, it is possible to improve the degree of design freedom of the power divider/combiner, and to obtain the same effect as that of the first embodiment.

Figure 14:
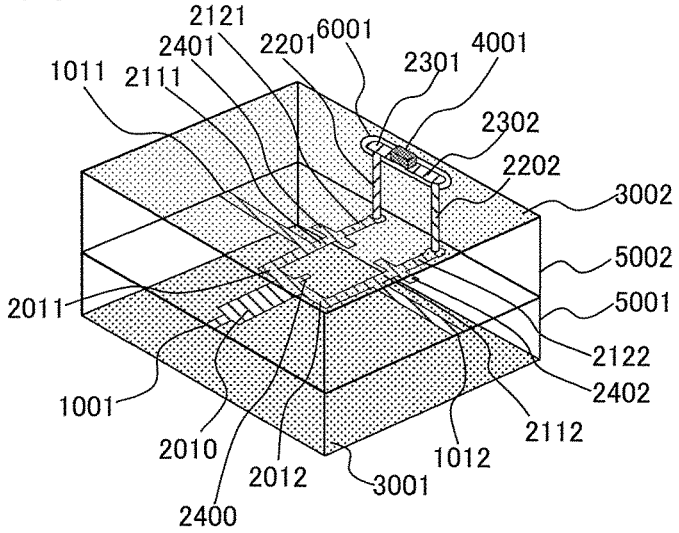
FIG. 14 is a transparent perspective view for illustrating another example of the configuration of the power divider/combiner according to the third embodiment of the present invention.

In addition, similarly to the power divider/combiner of FIG. 10, a stub 2400 may be provided between the λ/4 strip conductor 2011 and the λ/4 strip conductor 2012 as illustrated in FIG. 14.

Fourth Embodiment

Although, in the first, second, and third embodiments, a description has been given of the power divider/combiner including the chip resistor 4001 mounted on an outer surface of a multilayer board, a power divider/combiner may include the chip resistor 4001 mounted in a multilayer board inner layer.

Figure 13:
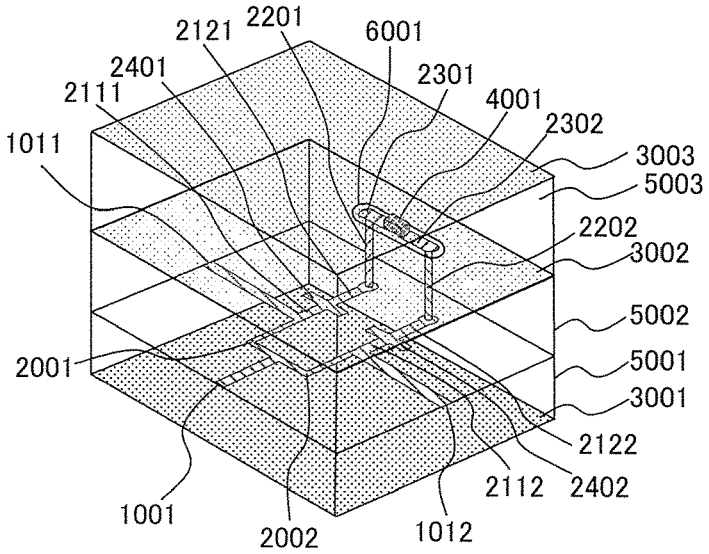
FIG. 13 is a transparent perspective view for illustrating an example of a configuration of a power divider/combiner according to a fourth embodiment of the present invention.

FIG. 13 is a configuration diagram for illustrating a power divider/combiner according to a fourth embodiment of the present invention, and is a transparent perspective view thereof.

In the example of FIG. 13 in the fourth embodiment, the chip resistor 4001 is arranged in a dielectric layer 5003, and a ground conductor 3003 is arranged on a surface of the dielectric layer 5003 opposite to a surface on which a dielectric layer 5002 is arranged.

According to the fourth embodiment, the chip resistor 4001 is arranged in the dielectric layer 5003, and thus it is possible to reduce an occupation area of a multilayer board outer surface, and to obtain the same effect as that of the above first embodiment.

In addition, features of the present invention are as follows.

For example, the transmission line strip conductor 2111 and the transmission line strip conductor 2121 form the first conductor cascade line (2111, 2121) in each of the above-mentioned embodiments.

Further, for example, the transmission line strip conductor 2112 and the transmission line strip conductor 2122 form the second conductor cascade line (2112, 2122).

It suffices that the first conductor cascade line (2111, 2121) and the second conductor cascade line (2112, 2122) are both formed by connecting at least two or more line portions of different impedances in cascade.

Further, it suffices that the first conductor cascade line (2111, 2121) is provided with the first stub (2401) at a line portion located at a center in a longitudinal direction of the first conductor cascade line or on a side closer to the first input/output terminal 1011 than the center.

Further, it suffices that the second conductor cascade line (2112, 2122) is provided with the second stub (2402) at a line portion located at a center in the longitudinal direction of the second conductor cascade line or on a side closer to the second input/output terminal 1012 than the center.

Further, the vias 2201 and 2202 form vertical connection conductors, and the ground outer conductor via 7001 and the ground outer conductor via 7002 form ground vertical conductors.

Fifth Embodiment

Although, in each of the above-mentioned embodiments, a description has been mainly given of a case in which stubs are provided one by one from the input/output terminal 1011 to the chip resistor mounting conductor pattern 2301 and from the input/output terminal 1012 to the chip resistor mounting conductor pattern 2302, but two or more stubs may be provided.

In addition, the features of the present invention are as follows.

When a total length of the transmission line strip conductor 2111, the transmission line strip conductor 2121, the chip resistor mounting conductor pattern 2301 and the via 2201, and a total length of the transmission line strip conductor 2112, the transmission line strip conductor 2122, the chip resistor mounting conductor pattern 2302, and the via 2202 are an odd multiple of an integer multiple of half a wavelength (λ/2) in each of the above embodiments, it is possible to provide an effect of providing a power divider/combiner that can adjust reflection characteristics of the input/output terminal during an odd mode operation, and have satisfactory various reflection characteristics and isolation characteristics during a power dividing operation and a power combining operation.

Further, when the total length of the transmission line strip conductor 2111, the transmission line strip conductor 2121, the chip resistor mounting conductor pattern 2301, and the via 2201, and the total length of the transmission line strip conductor 2112, the transmission line strip conductor 2122, the chip resistor mounting conductor pattern 2302, and the via 2202 are an even multiple of the integer multiple of half the wavelength (λ/2), it is possible to provide an effect of providing the power divider/combiner that can adjust reflection characteristics of the input/output terminal during an even mode operation, and have satisfactory various reflection characteristics and isolation characteristics during the power dividing operation and the power combining operation.

In addition, in a case where when the above-mentioned line length is an odd multiple of half the wavelength (λ/2) and in a case where the line length is an even multiple of half the wavelength (λ/2), the number of stubs may be one or more in each case.

Through provision of two or more stubs at λ/4 wavelength intervals from the input/output terminal 1011 to the chip resistor mounting conductor pattern 2301 and from the input/output terminal 1012 to the chip resistor mounting conductor pattern 2302, it is possible to provide an effect of providing the power divider/combiner that can adjust reflection characteristics of the input/output terminal during the even mode operation and have satisfactory various reflection characteristics and isolation characteristics during the power dividing operation and the power combining operation.

Figure 15:
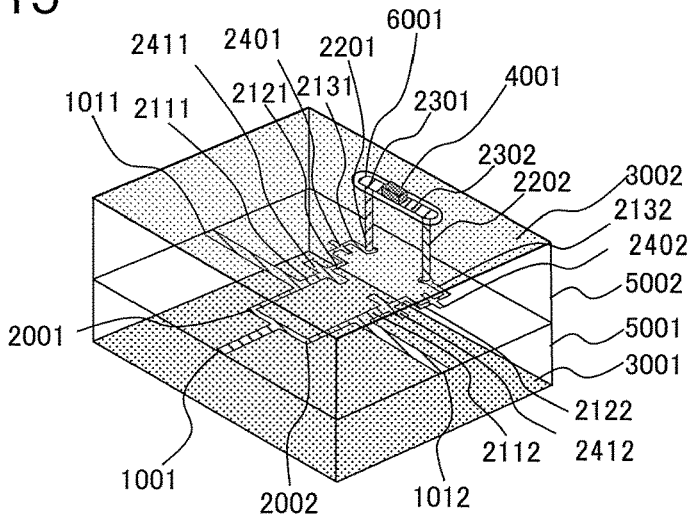
FIG. 15 is a transparent perspective view for illustrating an example of a configuration of a power divider/combiner according to a fifth embodiment of the present invention.

Although, in an example of FIG. 15 in a fifth embodiment of the present invention, a length relationship is not clear from FIG. 15, a first line, which is formed by the transmission line strip conductor 2111, the transmission line strip conductor 2121, a transmission line strip conductor 2131, the chip resistor mounting conductor pattern 2301, and the via 2201, and has the length that is an even multiple of half the wavelength, is provided with the stub 2401 located at a line portion at the center in the longitudinal direction or on a side closer to the input/output terminal 1011 than the center, and a stub 2411 located at a line portion that is apart by a quarter wavelength from the stub 2401 toward the input/output terminal 1011.

Further, a second line, which is formed by the transmission line strip conductor 2112, the transmission line strip conductor 2122, a transmission line strip conductor 2132, the chip resistor mounting conductor pattern 2302, and the via 2202, and has the length that is an even multiple of half the wavelength, is provided with the stub 2402 located at a line portion at the center in the longitudinal direction or on a side closer to the input/output terminal 1012 than the center, and a stub 2412 located at a line portion that is apart by a quarter wavelength from the stub 2402 to the input/output terminal 1012.

Figure 16:
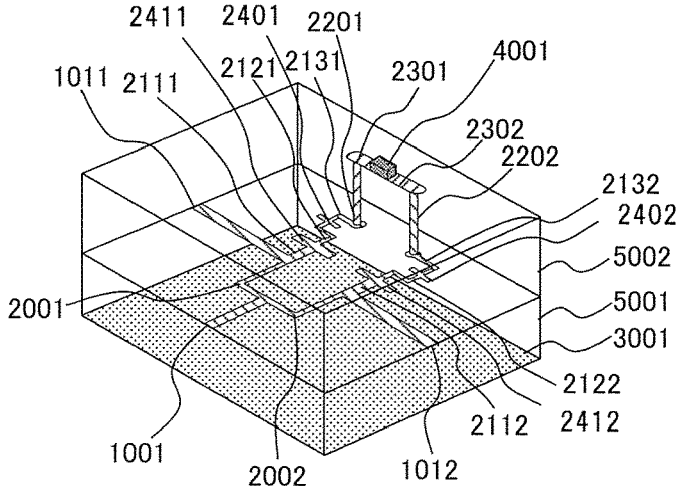
FIG. 16 is a transparent perspective view for illustrating another example of the configuration of the power divider/combiner according to the fifth embodiment of the present invention.

In the example of FIG. 15 in the fifth embodiment, a description has been given of a case in which the strip lines are used. However, the present invention is not limited to this, and microstrip lines may be used. FIG. 16 is a configuration diagram for illustrating the power divider/combiner that uses the microstrip lines according to the fifth embodiment of the present invention, and is a transparent perspective view thereof. The microstrip line adopts a structure that makes dielectric layers and outer conductors above inner conductors indicated as, for example, a ground conductor 3002 unnecessary on the strip lines of each of the above-mentioned examples.

Further, in FIG. 5, a common terminal 0001 corresponds to the common terminal 1001, transmission lines 0021 and 0022 correspond to the λ/4 impedance transformer strip conductors 2001 and 2002, input/output terminals 0011 and 0012 correspond to the input/output terminals 1011 and 1012, and a resistor 0041 corresponds to the chip resistor 4001.

The transmission lines 0331, 0431 and 0231 of FIG. 5 correspond to the transmission line strip conductors 2111 and 2121, the chip resistor mounting conductor pattern 2301, and the via 2201, and further include the transmission line strip conductor 2131 in cases of FIG. 15 and FIG. 16.

The transmission lines 0332, 0432 and 0232 correspond to the transmission line strip conductors 2112 and 2122, the chip resistor mounting conductor pattern 2302, and the via 2202, and further include the transmission line strip conductor 2132 in the cases of FIG. 15 and FIG. 16.

The stub 0051 corresponds to the stub 2401, and further includes the stub 2411 in the cases of FIG. 15 and FIG. 16. The stub 0052 corresponds to the stub 2402, and further includes the stub 2412 in the cases of FIG. 15 and FIG. 16.

Further, the present invention is not limited to the example of each of the above-mentioned embodiments, and includes all of possible combinations of those embodiments.

According to one embodiment of the present invention, there is provided a power divider/combiner, including:

a common terminal (1001) configured to receive input of a high frequency signal to be divided, or output a combined high frequency signal;

a first input/output terminal and a second input/output terminal (1011, 1012), which are configured to output a divided high frequency signal or receive input of a high frequency signal to be combined;

a first quarter-wave impedance transformer (2001) including one end connected to the common terminal and another end connected to the first input/output terminal;

a second quarter-wave impedance transformer (2002) including one end connected to the common terminal and another end connected to the second input/output terminal;

an isolation resistor (4001) configured to prevent an interference between the high frequency signal of the first input/output terminal and the high frequency signal of the second input/output terminal;

a first line (2111, 2121, 2201, 2301) configured to connect the isolation resistor and the first input/output terminal, and having a length that is an integer multiple of half a wavelength; and a second line (2112, 2122, 2202, 2302) configured to connect the isolation resistor and the second input/output terminal, and having a length that is an integer multiple of half a wavelength, wherein at least two or more of line portions of the first line (2111, 2121, 2201, 2301) and the second line (2112, 2122, 2202, 2302) have different impedances and are connected in cascade, wherein the first line (2111, 2121, 2201, 2301) includes a first stub (2401) at a line portion located at a center in a longitudinal direction of the first line or on a side closer to the first input/output terminal than the center, and wherein the second line (2112, 2122, 2202, 2302) includes a second stub (2402) at a line portion located at a center in a longitudinal direction of the second line or on a side closer to the second input/output terminal than the center.

Further, according to one embodiment of the present invention, there is provided a power divider/combiner, including:

a common terminal (1001) configured to receive input of a high frequency signal to be divided, or output a combined high frequency signal;

a first input/output terminal and a second input/output terminal (1011, 1012), which are configured to output a divided high frequency signal or receive input of a high frequency signal to be combined;

a quarter-wave impedance transformer (2010) including one end connected to the common terminal;

a first quarter-wave line (2011) including one end connected to the quarter-wave impedance transformer, and another end connected to the first input/output terminal;

a second quarter-wave line (2012) including one end connected to the quarter-wave impedance transformer, and another end connected to the second input/output terminal;

an isolation resistor (4001) configured to prevent an interference between a high frequency signal of the first input/output terminal and a high frequency signal of the second input/output terminal;

a first line (2111, 2121, 2201, 2301) configured to connect the isolation resistor and the first input/output terminal, and having a length that is an integer multiple of half a wavelength; and a second line (2112, 2122, 2202, 2302) configured to connect the isolation resistor and the second input/output terminal, and having a length that is an integer multiple of half a wavelength, wherein at least two or more of line portions of the first line (2111, 2121, 2201, 2301) and the second line (2112, 2122, 2202, 2302) have different impedances and are connected in cascade, wherein the first line (2111, 2121, 2201, 2301) includes a first stub (2401) at a line portion located at a center in a longitudinal direction of the first line or on a side closer to the first input/output terminal than the center, and wherein the second line (2112, 2122, 2202, 2302) includes a second stub (2402) at a line portion located at a center in a longitudinal direction of the second line or on a side closer to the second input/output terminal than the center.

In addition, the power divider/combiner further includes a third stub (2400) provided between the first quarter-wave impedance transformer (2001) and the second quarter-wave impedance transformer (2002).

In addition, the power divider/combiner further includes a third stub (2400) provided between the first quarter-wave line (2011) and the second quarter-wave line (2012).

In addition, the power divider/combiner further includes a multilayer board including:

a strip conductor of a multilayer board inner layer forming each of the terminals, the transformers, the lines, and the stubs;

a chip resistor (4001) forming the isolation resistor and mounted on an outer surface of the multilayer board; and a vertical connection conductor (2201, 2202) configured to connect the strip conductor and the chip resistor.

In addition, the power divider/combiner further includes a multilayer board including:

a strip conductor of a multilayer board inner layer forming each of the terminals, the transformers, the lines, and the stubs;

a chip resistor (4001) forming the isolation resistor and mounted on the multilayer board inner layer; and a vertical connection conductor (2201, 2202) configured to connect the strip conductor and the chip resistor.

In addition, the power divider/combiner further includes a ground vertical conductor (7001, 7002) provided around the vertical connection conductor (2201, 2202).

In addition, the first line (2111, 2121, 2201, 2301) and the second line (2112, 2122, 2202, 2302) have lengths that are each an odd multiple of half a wavelength.

In addition, the first line (2111, 2121, 2201, 2301) and the second line (2112, 2122, 2202, 2302) have lengths that are each an even multiple of half a wavelength.

In addition, the first line (2111, 2121, 2201, 2301) includes a fourth stub (2411) at a line portion between the first stub and the first input/output terminal side, and the second line (2112, 2122, 2202, 2302) includes a fifth stub (2412) at a line portion between the second stub and the second input/output terminal side.

INDUSTRIAL APPLICABILITY

The power divider/combiner according to the present invention is applicable to power divider/combiners to be used in a large number of fields.

REFERENCE SIGNS LIST

0001, 1001 common terminal, 0011, 0012, 1011, 1012 input/output terminal, 0021, 0022, 0131, 0132, 0231, 0232, 0331, 0332, 0431, 0432 transmission line, 0041 resistor, 0051, 0052, 2400, 2401, 2402, 2411, 2412, 2501, 2502 stub, 2111, 2112, 2121, 2122, 2131, 2132 transmission line strip conductor, 2001, 2002 λ/4 impedance transformer strip conductors (λ/4 impedance transformer), 2010 λ/4 impedance transformer strip conductor (λ/4 impedance transformer), 2011, 2012 λ/4 strip conductor (λ/4 line), 2201, 2202, 2211, 2212, 2501, via, 2301, 2302 chip resistor mounting conductor pattern, 3001, 3002, 3003, 3011, 3012 ground conductor, 4001 chip resistor, 5001-5004, 5011 dielectric layer, 7001, 7002 ground outer conductor via

The invention claimed is:

1. A power divider/combiner, comprising:

a common terminal configured to receive input of a high frequency signal to be divided, or output a combined high frequency signal;

a first input/output terminal and a second input/output terminal, which are configured to output a divided high frequency signal or receive input of a high frequency signal to be combined;

a first quarter-wave impedance transformer including one end connected to the common terminal and another end connected to the first input/output terminal;

a second quarter-wave impedance transformer including one end connected to the common terminal and another end connected to the second input/output terminal;

an isolation resistor configured to prevent an interference between a high frequency signal of the first input/output terminal and a high frequency signal of the second input/output terminal;

a first line configured to connect the isolation resistor and the first input/output terminal, and having a length that is an integer multiple of half a wavelength; and a second line configured to connect the isolation resistor and the second input/output terminal, and having a length that is an integer multiple of half a wavelength, wherein at least two or more of line portions of the first line and the second line have different impedances and are connected in cascade, wherein the first line includes a first stub at a line portion located at a center in a longitudinal direction of the first line or on a side closer to the first input/output terminal than the center, and wherein the second line includes a second stub at a line portion located at a center in a longitudinal direction of the second line or on a side closer to the second input/output terminal than the center.

2. The power divider/combiner according to claim 1, further comprising a third stub provided between the first quarter-wave impedance transformer and the second quarter-wave impedance transformer.

3. The power divider/combiner according to claim 1, comprising a multilayer board including:

a strip conductor of the multilayer board inner layer forming each of the terminals, the transformers, the lines, and the stubs;

a chip resistor forming the isolation resistor and mounted on an outer surface of the multilayer board; and a vertical connection conductor configured to connect the strip conductor and the chip resistor.

4. The power divider/combiner according to claim 3, further comprising a ground vertical conductor provided around the vertical connection conductor.

5. The power divider/combiner according to claim 1, comprising a multilayer board including:

a strip conductor of the multilayer board inner layer forming each of the terminals, the transformers, the lines, and the stubs;

a chip resistor forming the isolation resistor and mounted on the multilayer board inner layer; and a vertical connection conductor configured to connect the strip conductor and the chip resistor.

6. The power divider/combiner according to claim 5, further comprising a ground vertical conductor provided around the vertical connection conductor.

7. The power divider/combiner according to claim 1, wherein the first line and the second line have lengths that are each an odd multiple of half a wavelength.

8. The power divider/combiner according to claim 1, wherein the first line and the second line have lengths that are each an even multiple of half a wavelength.

9. The power divider/combiner according to claim 1, wherein the first line includes a fourth stub at a line portion between the first stub and the first input/output terminal side, and wherein the second line includes a fifth stub at a line portion between the second stub and the side of the second input/output terminal side.

10. A power divider/combiner, comprising:

a common terminal configured to receive input of a high frequency signal to be divided, or output a combined high frequency signal;

a first input/output terminal and a second input/output terminal, which are configured to output a divided high frequency signal or receive input of a high frequency signal to be combined;

a quarter-wave impedance transformer including one end connected to the common terminal;

a first quarter-wave line including one end connected to the quarter-wave impedance transformer, and another end connected to the first input/output terminal;

a second quarter-wave line including one end connected to the quarter-wave impedance transformer, and another end connected to the second input/output terminal;

an isolation resistor configured to prevent an interference between a high frequency signal of the first input/output terminal and a high frequency signal of the second input/output terminal;

a first line configured to connect the isolation resistor and the first input/output terminal, and having a length that is an integer multiple of half a wavelength; and a second line configured to connect the isolation resistor and the second input/output terminal, and having a length that is an integer multiple of half a wavelength, wherein at least two or more of line portions of the first line and the second line have different impedances and are connected in cascade, wherein the first line includes a first stub at a line portion located at a center in a longitudinal direction of the first line or on a side closer to the first input/output terminal than the center, and wherein the second line includes a second stub at a line portion located at a center in a longitudinal direction of the second line or on a side closer to the second input/output terminal than the center.

11. The power divider/combiner according to claim 10, further comprising a third stub provided between the first quarter-wave line and the second quarter-wave line.

12. The power divider/combiner according to claim 10, comprising a multilayer board including:

a strip conductor of the multilayer board inner layer forming each of the terminals, the transformers, the lines, and the stubs;

a chip resistor forming the isolation resistor and mounted on an outer surface of the multilayer board; and a vertical connection conductor configured to connect the strip conductor and the chip resistor.

13. The power divider/combiner according to claim 12, further comprising a ground vertical conductor provided around the vertical connection conductor.

14. The power divider/combiner according to claim 10, comprising a multilayer board including:

a strip conductor of the multilayer board inner layer forming each of the terminals, the transformers, the lines, and the stubs;

a chip resistor forming the isolation resistor and mounted on the multilayer board inner layer; and a vertical connection conductor configured to connect the strip conductor and the chip resistor.

15. The power divider/combiner according to claim 14, further comprising a ground vertical conductor provided around the vertical connection conductor.

16. The power divider/combiner according to claim 10, wherein the first line and the second line have lengths that are each an odd multiple of half a wavelength.

17. The power divider/combiner according to claim 10, wherein the first line and the second line have lengths that are each an even multiple of half a wavelength.

18. The power divider/combiner according to claim 10, wherein the first line includes a fourth stub at a line portion between the first stub and the first input/output terminal side, and wherein the second line includes a fifth stub at a line portion between the second stub and the side of the second input/output terminal side.

* * * * *